United States Patent [19]

Eberhart

[11] 4,069,558

[45] Jan. 24, 1978

[54] LATCH MECHANISM

[76] Inventor: Ray Eberhart, 317 E. Jefferson Blvd., Mishawaka, Ind. 46544

[21] Appl. No.: 630,254

[22] Filed: Nov. 10, 1975

[51] Int. Cl.[2] ..... A44B 11/25; A44B 21/00

[52] U.S. Cl. ..... 24/230 R; 24/230 AK; 24/211 R

[58] Field of Search ..... 24/230 AK, 230 AM, 52, 24/211 R, 230 R

[56] References Cited

U.S. PATENT DOCUMENTS

| | | | |
|---|---|---|---|
| 2,464,543 | 3/1949 | Modrey | 24/211 R |
| 2,465,328 | 3/1949 | Modrey | 24/211 R |
| 3,152,377 | 10/1964 | Carter | 24/230 AK |
| 3,336,641 | 8/1967 | Hunter | 24/230 AK |
| 3,796,461 | 3/1974 | Cucheran | 24/230 AM |

FOREIGN PATENT DOCUMENTS

| | | | |
|---|---|---|---|
| 1,065,220 | 5/1954 | France | 24/211 R |
| 1,561,054 | 3/1969 | France | 24/230 AK |
| 311,295 | 6/1969 | Sweden | 24/230 R |

*Primary Examiner*—Bernard A. Gelak
*Attorney, Agent, or Firm*—Marmaduke A. Hobbs

[57] ABSTRACT

A latch mechanism for use in safety belt buckles, connectors and couplings, in which a female portion is provided with a slot having two opposed edges and inner and outer wall surfaces on opposite sides of the slot edges, and a male portion having a member with a forward end and a shoulder thereon for extending through the slot and seating on the inner surface of the female portion. A member movable toward and away from the forward end of the first member is adapted to seat in the slot when the first member is disposed therein, for holding the first member in the slot and the shoulder in engagement with the inner surface of the part defining the slot. The second member is urged toward the forward end of the first member by a spring or other suitable resilient means, and an operating means, preferably consisting of a push button, handle or stem, is provided for retracting the second member.

10 Claims, 14 Drawing Figures

Fig. 1
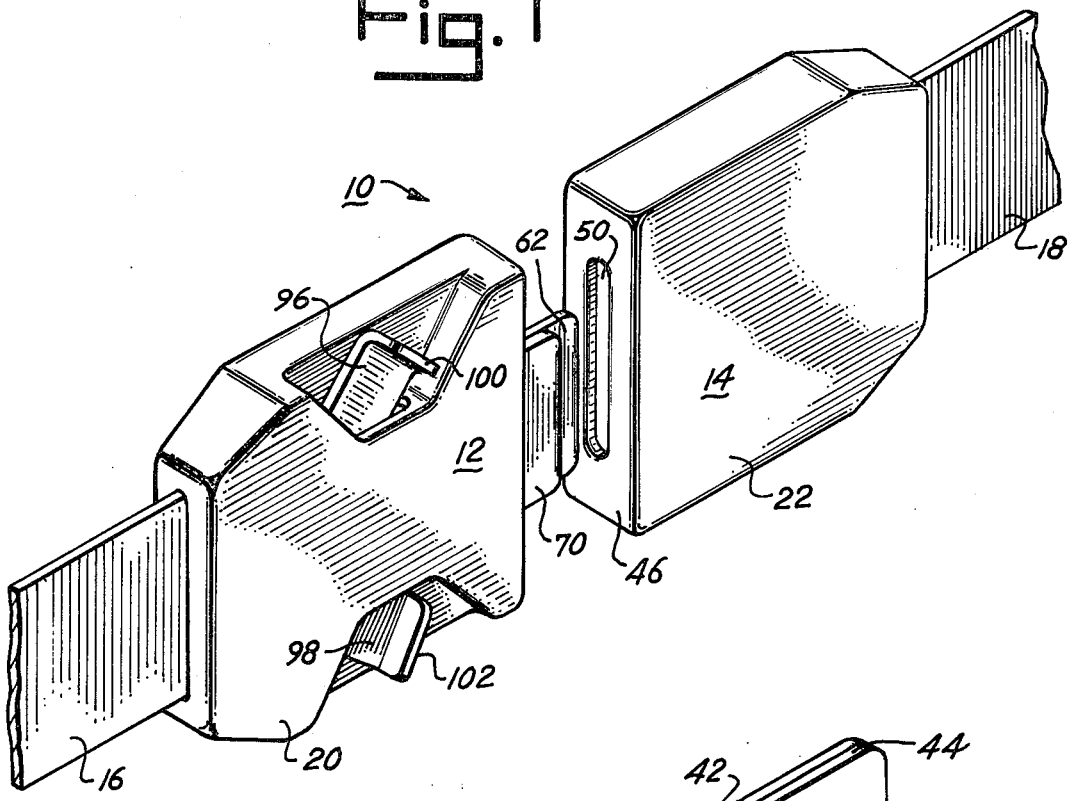
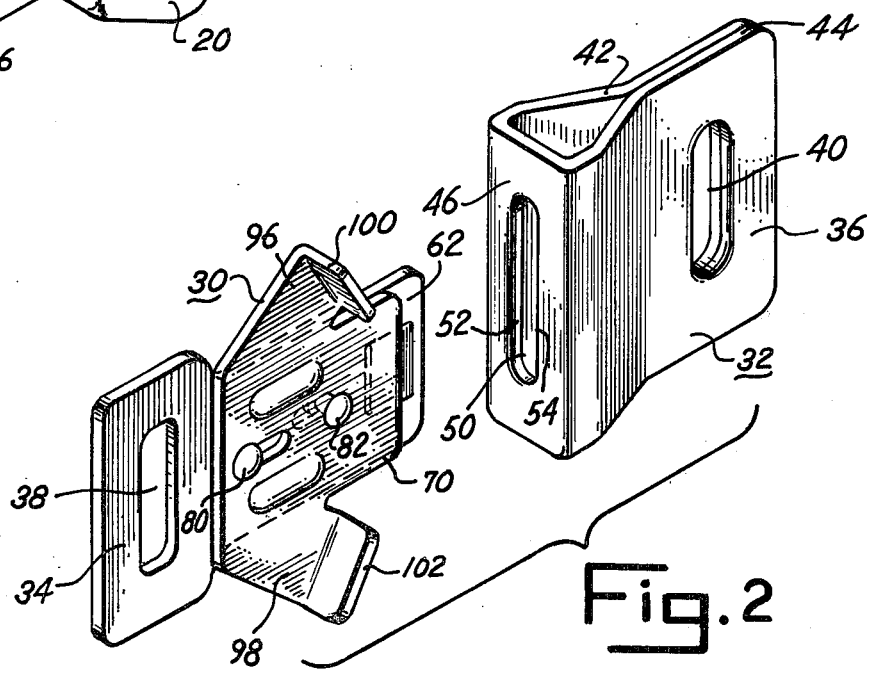
Fig. 2

Fig. 3
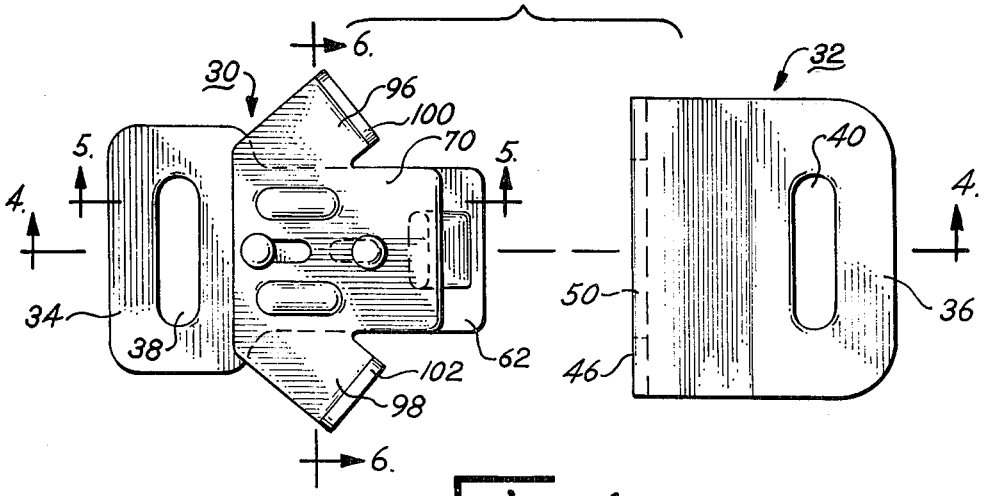
Fig. 4
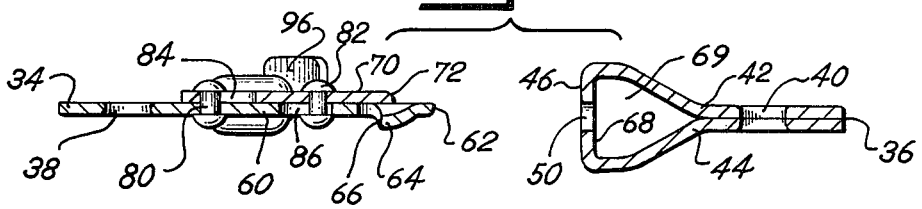
Fig. 5
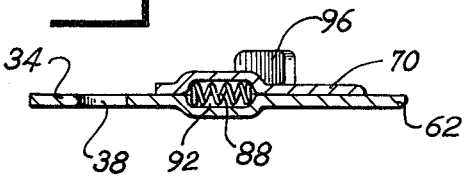
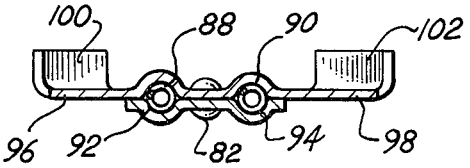
Fig. 6

Fig. 7
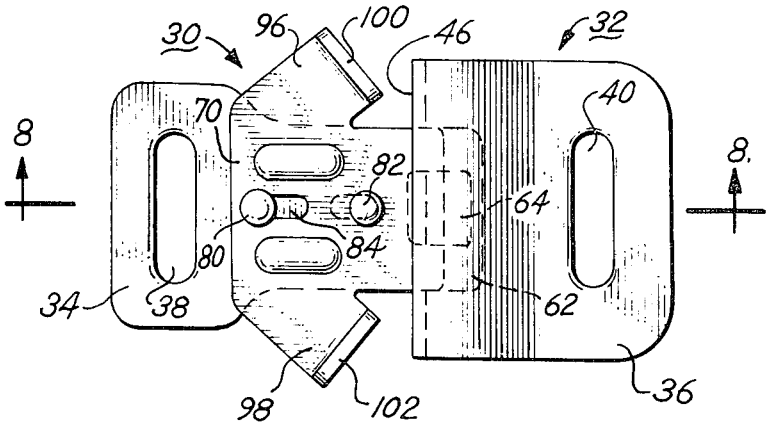
Fig. 8
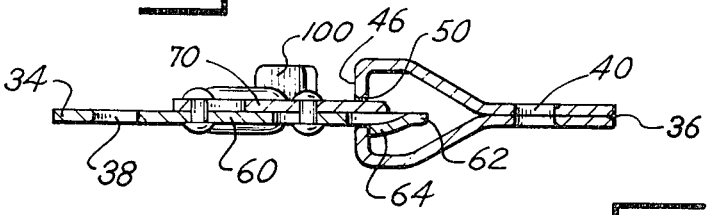
Fig. 9
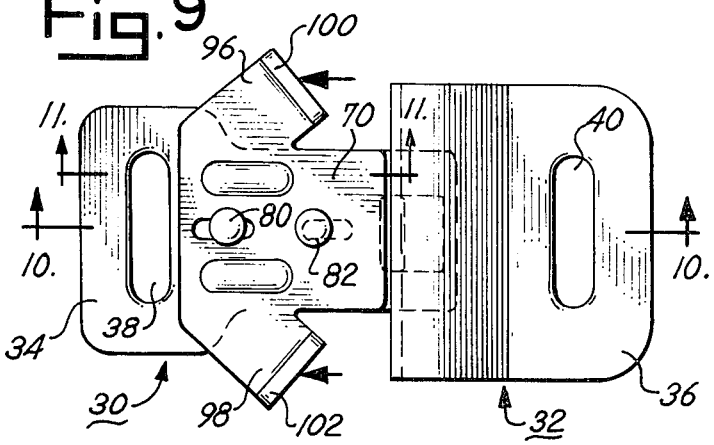
Fig. 11
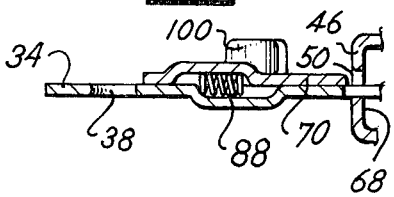
Fig. 12
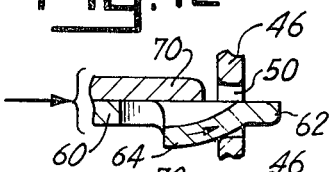
Fig. 13
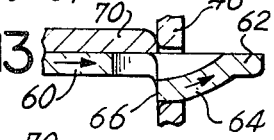
Fig. 14
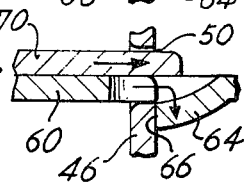
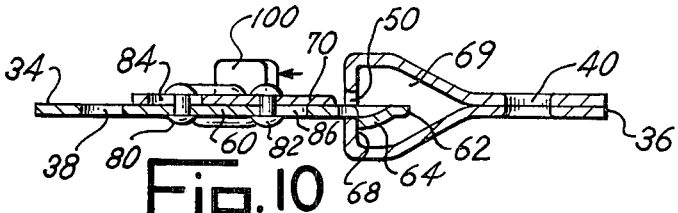
Fig. 10

LATCH MECHANISM

Latch mechanisms used in safety buckles must latch easily, hold firmly under substantial and suddenly applied forces, and unlatch fully and immediately when the buckle release means is operated. Various types of latch mechanisms have been used in safety belt buckles, these usually being operated by either a pivoted lever which is lifted away from the person's body to unlatch the mechanism, or by a push button in the center of the buckle which is pressed inwardly toward the person's body to depress a lever which unlatches the latch mechanism. Problems are often encountered in constructing the buckles of the foregoing type with sufficient strength and simplicity to be reliable and safe under adverse conditions of operation, including all types of accidents. The conventional push button type safety belt buckle used in automotive vehicles is relatively complicated and requires close tolerances between the operating parts in order to meet minimum safety and reliability standards. These same problems are present in the fabrication and operation of the latch mechanism of connectors and couplings often used in the tractor, truck and railroad fields. It is therefore one of the principal objects of the present invention to provide a latch mechanism for safety buckles, connectors and couplings, which is simple in construction and operation, and which will operate safely and reliably without strict tolerances being maintained between the operating parts of the mechanism.

Another object of the invention is to provide a latch mechanism for safety buckles and other connectors and couplings, which is constructed essentially of two easily connected and disconnected parts, and which can be operated by means of a push button, pivoted lever or sliding bar or bolt.

Still another object of the invention is to provide a latch mechanism of the aforesaid type which can be fabricated mostly from metal, by simple stamping and bending operations, and the parts of which can be easily assembled into the completed latch mechanism and thereafter effectively inspected from time to time for wear or other defects.

A further object is to provide a latch mechanism for a variety of different types of connectors, couplings and the like, which is compact in size and strong and rugged in construction, and which will give long, reliable and trouble-free service.

Additional objects and advantages of the present invention will become apparent from the following description and accompanying drawings, wherein:

FIG. 1 is a perspective view of a vehicle safety belt buckle embodying the present latch mechanism and showing the buckle connected to two sections of a safety strap;

FIG. 2 is a perspective view of the latch mechanism used in the buckle in FIG. 1;

FIG. 3 is a plan view of the male and female portions of the latch mechanism seen in FIG. 2, showing the portions separated;

FIG. 4 is a cross sectional view of the parts shown in FIG. 3, the section being taken on line 4—4 of the latter figure;

FIG. 5 is a sectional view of the male portion of the latch mechanism, the section being taken on line 5—5 of FIG. 3;

FIG. 6 is another sectional view of the male portion of the latch mechanism, the section being taken on line 6—6 of FIG. 3;

FIG. 7 is a plan view of the latch mechanism, showing the parts thereof in connected position;

FIG. 8 is a cross sectional view of the latch mechanism with the portions connected, the section being taken on line 8—8 of FIG. 7;

FIG. 9 is a plan view of the buckle with the parts shown in connected relationship, with the mechanism in the operating position for connecting or disconnecting the two portions;

FIG. 10 is a cross sectional view of the latch mechanism in the condition shown in FIG. 9, the section being taken on line 10—10 of the latter figure;

FIG. 11 is a fragmentary cross sectional view of the two parts of the latch mechanism shown in FIG. 9, further illustrating the operating relationship of the parts; and FIGS. 12, 13 and 14 are enlarged fragmentary cross sectional views illustrating the manner in which the parts operate when the male and female portions of the buckle are being connected to one another.

Referring more specifically to the drawings, and to FIG. 1 in particular, numeral 10 indicates generally a belt buckle having the present latch mechanism therein, the buckle consisting of a male portion 12 and a female portion 14, the two portions being shown separated from one another and connected to belt sections 16 and 18, respectively, for an automobile or other similar type of vehicle. The latch mechanism for the safety belt is enclosed in housings 20 and 22 of portions 12 and 14. The housings may be of any suitable material, such as plastic or metal, and may be of various designs, depending upon the intended use and the particular hand operating means for the latch mechanism. Various other housing configurations and designs may be used if desired.

The latch mechanism consists of a male portion 30 and a female portion 32, the two portions having strap connector parts 34 and 36 with elongated holes 38 and 40 therein for receiving the ends of strap sections 16 and 18, respectively. The female portion shown in the drawing consists of a formed metal element unit having side walls 42 and 44 and end wall 46 connected to and formed integrally with the two sides, and having an elongated slot 50 therein facing the male portion 30. The unit formed by walls 42, 44 and 46 is rigid and of sufficient strength that it will not be deformed under high stresses placed upon it when the two latch parts are interconnected. The lips 52 and 54 of elongated hole 50 must be strong enough to remain firmly in the position shown for satisfactory operation of the latch mechanism under high stress conditions such as may occur during a vehicle accident.

The male portion of the latch mechanism of the embodiment of the invention illustrated in FIGS. 1 through 14 consists of a base plate or member 60 connected integrally with strap part 34, and has a forward end portion 62 in which a lug 64 is formed, the rearward edge 66 of which forming an abutment or shoulder which engages the inner side 68 of end wall 46 when the two parts are engaged in latching relationship with the forward end 62 extending through elongated slot 50 into the hollow interior 69 of female portion 32. The slot 50 is sufficiently wide to permit the flat forward end 62 and lug 64 to pass freely therethrough; however, it is preferable that the width of the slot be only slightly larger than the combined thickness of plate 60 and lug 64. After the forward end 62 has passed inwardly through the slot, the lug seats on the inner side of end wall 46 with edge 66 engaging surface 68.

End 62 and lug 64 are held in slot 50 with the lug engaging the inner surface 68, by a sliding member 70 which has a forward end 72 adapted to extend into slot 50 when lug 64 is seated on the inner side of wall 46. Thus, when member 70 is inserted in the slot, the combined thickness of plate 60 and member 70 is sufficient to prevent plate 60 and lug 64 from slipping outwardly through slot 50. Member 70 is slidably mounted on plate 60 by rivets 80 and 82 disposed in slots 84 and 86, respectively, and the member is urged toward the forward end 62 of plate 60 by a couple of coil springs 88 and 90 disposed in sockets 92 and 94 formed in the plate end member. The springs bear against the two end walls of each socket to urge the member toward its forward position after it has been withdrawn to permit insertion of end 62 and lug 64 through slot 50. When member 70 has been withdrawn and the forward end 62 and lug 64 have been inserted in slot 50, releasing member 70 permits the two springs to return the forward end of the member to the position where it extends into slot 50.

In the embodiment of the latch mechanism shown in FIGS. 1 through 14, the member 70 is withdrawn against the force of springs 88 and 90 by operating stems 96 and 98 connected rigidly and preferably integrally with member 70, and having push buttons 100 and 102 on the outer ends thereof to permit the two stems and member to be easily moved to a retracted position. Upon the release of the retracting pressure on the two buttons by the hand, the two springs return the member 70 to its forward position, where it locks end 62 and lug 64 in slot 50 if the two buckle portions are in latching position.

In the operation of the latch mechanism in the safety buckle disclosed in the embodiment of FIGS. 1 through 14, with strap parts 34 and 36 connected to strap sections 16 and 18, respectively, the male and female portions are connected to one another by the operator withdrawing member 70 from the position shown in FIGS. 3 and 4 to the position shown in FIGS. 10 through 13. With member 70 held by the operator in the withdrawn position by pressure on buttons 100 and 102, the forward end 62 of plate 60 and lug 64 are inserted through slot 50 in the manner illustrated in FIGS. 12, 13 and 14, to the position where lug 64 seats downwardly or inwardly behind end 46 on surface 68. With the lug seated in the position illustrated in FIGS. 10 and 14, member 70 is released, permitting springs 88 and 90 to return member 70 to its forward position. When the member is in this position, it extends into slot 50 in the manner illustrated in FIGS. 7, 8 and 14. Since the combined thickness of plate 60 and member 70 is only slightly less than the width of slot 50, lug 64 is held downwardly or inwardly below the slot, with shoulder 66 in engagement with the inner side of end wall 46.

The spring holds member 70 in the slot, and hence, the latch mechanism remains latched until member 70 is intentionally withdrawn, using, in the embodiment described in FIGS. 1 through 14, stems 96 and 98 by pressing on buttons 100 and 102 in the direction to slide member 70 to the left, as viewed in the drawings, to the point where the forward end of the member is no longer extending into slot 50. With the member withdrawn in this manner, plate 60 can be lifted or moved toward the opposite side of the slot from the position shown in FIGS. 10 and 13, thus permitting the lug 64 to disengage itself from the inner surface of end wall 46 and to pass outwardly through the slot.

The locking operation can be performed by merely pushing the forward end 62 of plate 60 through slot 50, since the forward side of the lug is curved in a manner which urges the plate 60 upwardly and member 70 against the outer side of end wall 46. Thereupon, further pressure pressing the two portions of the buckle together causes the forward end of member 70 to press against end wall 46, retracting member 70 rearwardly relative to plate 60 permitting the forward end 62 and lug 64 to pass through slot 50. This single step operation of latching the mechanism is best illustrated in FIG. 13 wherein the forward end of member 70 is pressed against end wall 46 as the forward end 62 of plate 60 is pushed through slot 50. As long as member 70 is seated in slot 50 along with plate 60, lug 64 is held on the inner side of wall 46, preventing the lug from becoming accidentally disengaged. FIGS. 7, 8, 10 and 14 illustrate the buckle in its fully latched position, and FIG. 9 illustrates the first step of unlatching the mechanism by the withdrawal of member 70 from slot 50, the bold arrows illustrating the direction of applied pressure on buttons 100 and 102 for retracting member 70. The arrows in FIGS. 12, 13 and 14 illustrate the direction of travel of plate 60, member 70 and lug 64 as the mechanism is latched.

Although the drawings illustrate one type of push button operating means for member 70, in which the buttons are connected by laterally extending stems 96 and 98 to the member, other types of push button structures may be used. With slight modification, the latch can be operated by a push button of the type used in the conventional automobile safety belt buckles, wherein the button is pushed inwardly toward the body of the passenger to release the buckle. This type of operation can readily be adapted to the present latch mechanism by the use, for example, of either a pivoted lever or cam. Other types of operating mechanisms, with or without push buttons, may be used in place of the one illustrated, including the pivoted lever type such as those normally used on planes. Notwithstanding the embodiment of the invention's being illustrated in a safety belt buckle, the latch mechanism disclosed herein and defined in the claims can readily be adapted to tractor and implement coupling devices, whereby the coupling operation can be performed without the tractor operator leaving the cab or his seat. The mechanism is also suitable for use in coupling trailers to trucks, tractors or other towing vehicles.

While only one embodiment of the present latch mechanism has been described in detail herein, various changes and modifications, including those mentioned hereinabove, may be made without departing from the scope of the invention.

I claim:

1. A latch mechanism comprising a female portion having two sides and an end joined integrally to form a one-piece structure, a means in said end defining a slot with two opposed edges and with an inner and outer wall surface on opposite sides of said slot edges, and a male portion having a first generally flat, plate-like member with a forward end and shoulder on a face thereof facing oppositely of said forward end for seating on the inner wall surface of said female portion and a second generally flat, plate-like member slidable on said first plate-like member toward and away from the forward end of said first member and into and from said slot when said first member is disposed therein and said shoulder is disposed adjacent said inner wall surface, the combined thickness of said first and second members in said slot and said shoulder being greater than the distance between said slot edges, such that said shoulder cannot be disengaged from said inner surface while both of said members are disposed in said slot.

2. A latch mechanism as defined in claim 1 in which said first and second members are in slidable contact with one another and a resilient means urges said second member toward the forward end of said first member.

3. A latch mechanism as defined in claim 1 in which an opeating means is attached to said second member for moving said second member away from the forward end of said first member.

4. A latch mechanism as defined in claim 2 in which an operating means is attached to said second member for moving said second member away from the forward end of said first member.

5. A latch mechanism as defined in claim 3 in which said operating means consists of a pair of stems extending laterally from said second member.

6. a latch mechanism as defined in claim 4 in which said operating means consists of a pair of stems extending laterally from said member and joined rigidly thereto.

7. A latch mechanism as defined in claim 2 in which said operating means consists of a push button and means connecting said push button with said second member for withdrawing said second member away from the forward end of said first member when said push button is pressed.

8. A latch mechanism as defined in claim 1 in which a means is provided on said male and female portions for connecting said portions to strap sections.

9. A latch mechanism as defined in claim 1 in which a resilient means urges the forward end of said second member toward the forward end of said first member.

10. A latch mechanism as defined in claim 9 in which a means is provided for retracting the forward end of said second member away from the forward end of said first member.

* * * * *